US011602202B2

(12) United States Patent
Picklo

(10) Patent No.: US 11,602,202 B2
(45) Date of Patent: Mar. 14, 2023

(54) SYSTEM AND METHOD FOR ATTACHING SIGNAGE TO APPAREL

(71) Applicant: Squirleez LLC, Washington, MI (US)

(72) Inventor: Ryan Michael Picklo, Leonard, MI (US)

(73) Assignee: SQUIRLEEZ LLC, Washington, MI (US)

( * ) Notice: Subject to any disclaimer, the term of this patent is extended or adjusted under 35 U.S.C. 154(b) by 182 days.

(21) Appl. No.: 17/320,580

(22) Filed: May 14, 2021

(65) Prior Publication Data

US 2022/0361636 A1 Nov. 17, 2022

(51) Int. Cl.
*A44C 25/00* (2006.01)
*A44C 17/02* (2006.01)

(52) U.S. Cl.
CPC ..... *A44C 25/007* (2013.01)

(58) Field of Classification Search
CPC ..... A44C 17/0208; A44C 17/0216; A44C 25/007; A44C 17/0241; G02C 11/02; A44B 1/18; A44B 6/00
USPC ..... 351/52; 63/23, 38
See application file for complete search history.

(56) References Cited

U.S. PATENT DOCUMENTS 367,449 A * 8/1887 Scott ..... A44C 17/0208 63/29.1
1,185,348 A * 5/1916 Rutledge ..... F16M 13/02 211/89.01
4,237,702 A * 12/1980 Caverly ..... A44C 17/0241 63/3.2
5,367,347 A * 11/1994 Wilson ..... G02C 11/00 24/3.3
5,630,259 A * 5/1997 Ricketts ..... A44B 6/00 24/49.1
5,654,787 A * 8/1997 Barison ..... G02C 11/02 351/52
7,677,722 B1 * 3/2010 Mednick ..... G02C 11/02 351/111
9,122,081 B2 * 9/2015 Akoubians ..... G02C 11/02
11,051,594 B1 * 7/2021 Eigenman ..... A44C 7/002
2003/0154742 A1 * 8/2003 Ooide ..... A44C 17/0216 63/38
2006/0230786 A1 * 10/2006 Mishima ..... A44C 5/18 63/38

(Continued)

*Primary Examiner* — Jack W Lavinder
(74) *Attorney, Agent, or Firm* — McAndrews, Held & Malloy, Ltd.

(57) ABSTRACT

A signage apparatus includes signage and an attachment mechanism. The signage includes front and rear faces. The attachment mechanism includes a base, a cap, outer stabilizers, and a flexible component. The base includes base upper and lower sides. The base upper side is attached to the rear face of the signage. The cap includes cap lower and upper sides. The outer stabilizers extend between outer cap portions of the cap upper side and outer base portions of the base lower side. The outer stabilizers, the cap upper side, and the base lower side form an aperture extending through the attachment mechanism. The flexible component extends between the outer stabilizers and between the cap upper side and the base lower side. The flexible component includes at least one slit. The attachment mechanism is configured to receive a piece of apparel through the at least one slit and the aperture.

20 Claims, 4 Drawing Sheets

(56) References Cited

U.S. PATENT DOCUMENTS

| | | | | |
|---|---|---|---|---|
| 2012/0297827 | A1* | 11/2012 | Mellinger | G02C 11/02 63/33 |
| 2014/0320796 | A1* | 10/2014 | Brodkin | G02C 11/02 351/52 |
| 2019/0324295 | A1* | 10/2019 | Marzano | G02C 11/02 |

* cited by examiner

SYSTEM AND METHOD FOR ATTACHING SIGNAGE TO APPAREL

FIELD

Certain embodiments relate to a signage apparatus. More specifically, certain embodiments provide an attachment mechanism fixedly attached to signage (e.g., a charm) and configured to detachably couple to apparel, such as a temple of eyeglasses, a bracelet, or shoelaces, for example, to securely hold the signage apparatus on the apparel.

BACKGROUND

Charms are personal, decorative pendants, trinkets, ornaments, or other signage that may be worn by a user on a bracelet, necklace, shoelaces, eyeglasses, or other apparel. However, the mechanisms configured to attach the charms to apparel may allow the charms to slide relatively freely on the apparel, may be difficult to attach to apparel, may be difficult to remove from apparel, and/or may be difficult to position on apparel at a substantially fixed position.

Further limitations and disadvantages of conventional and traditional approaches will become apparent to one of skill in the art, through comparison of such systems with some aspects of the present disclosure as set forth in the remainder of the present application with reference to the drawings.

BRIEF SUMMARY

A signage apparatus comprising signage affixed to an attachment mechanism configured to detachably couple to and securely hold the signage apparatus on apparel is provided, substantially as shown in and/or described in connection with at least one of the figures, as set forth more completely in the claims.

These and other advantages, aspects and novel features of the present disclosure, as well as details of an illustrated embodiment thereof, will be more fully understood from the following description and drawings.

DETAILED DESCRIPTION

Certain embodiments may be found in a signage apparatus configured to detachably couple to apparel. More specifically, certain embodiments provide an attachment mechanism including a base, cap, outer stabilizers, and a flexible component. The base may be fixedly attached to signage. The outer stabilizers may fixedly couple the base to the cap and provide an aperture between the outer stabilizers through the attachment mechanism. The flexible component may be positioned around and between the outer stabilizers. The flexible component includes slits on opposite sides of the flexible component that are positioned to align with the aperture between the outer stabilizers. The signage apparatus is configured to receive apparel, such as a temple of eyeglasses, a bracelet, or shoelaces, for example, through the slits of the flexible component and the aperture of the attachment mechanism to securely hold the signage apparatus on the apparel.

As used herein, an element recited in the singular and proceeded with the word "a" or "an" should be understood as not excluding the plural of the elements, unless such exclusion is explicitly stated. Furthermore, references to "an embodiment," "one embodiment," "a representative embodiment," "an exemplary embodiment," "various embodiments," "certain embodiments," and the like are not intended to be interpreted as excluding the existence of additional embodiments that also incorporate the recited features. Moreover, unless explicitly stated to the contrary, embodiments "comprising," "including," or "having" an element or a plurality of elements having a particular property may include additional elements not having that property.

Figure 1:
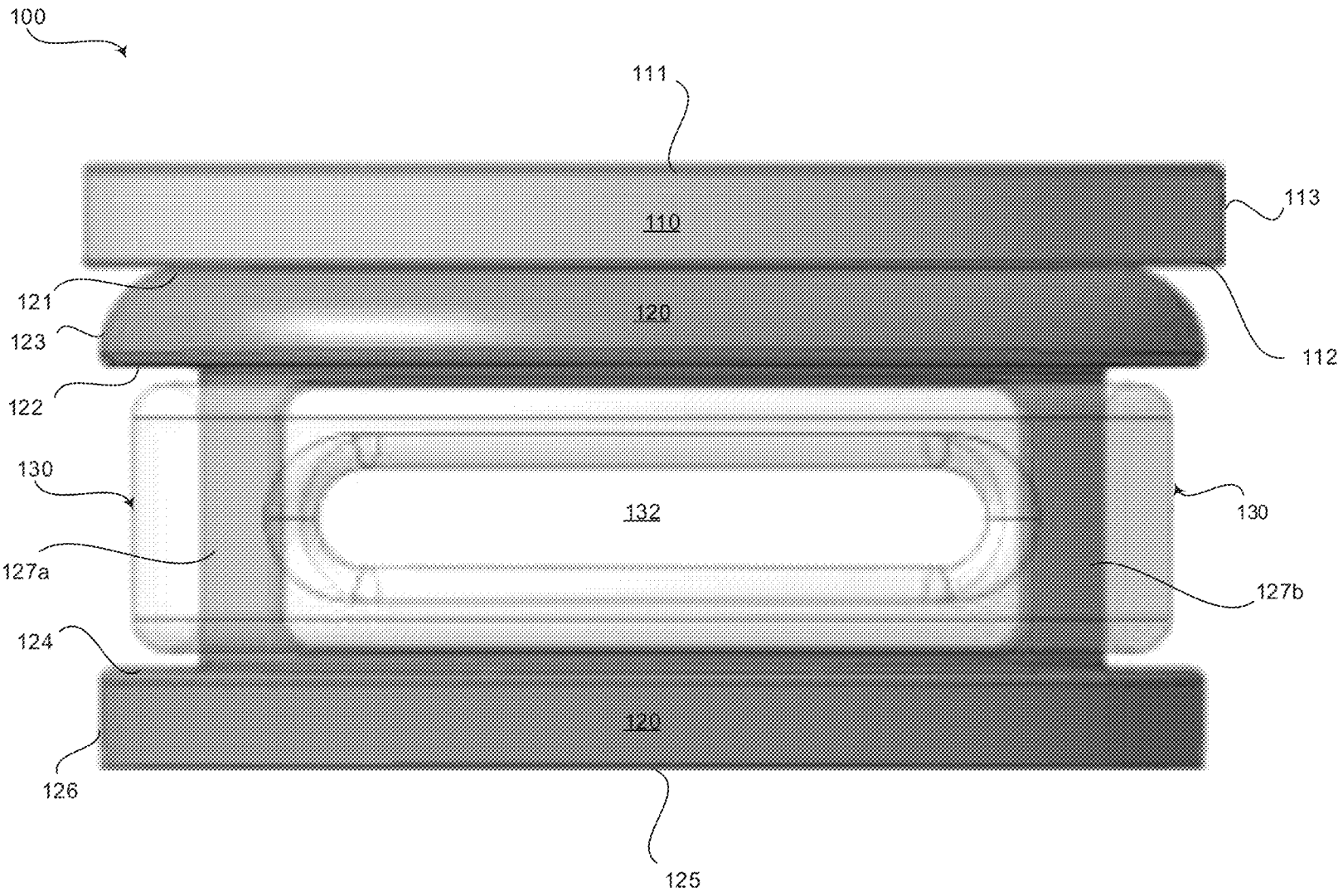
FIG. 1 is a front perspective view of an exemplary signage apparatus, in accordance with various embodiments.
Figure 2:
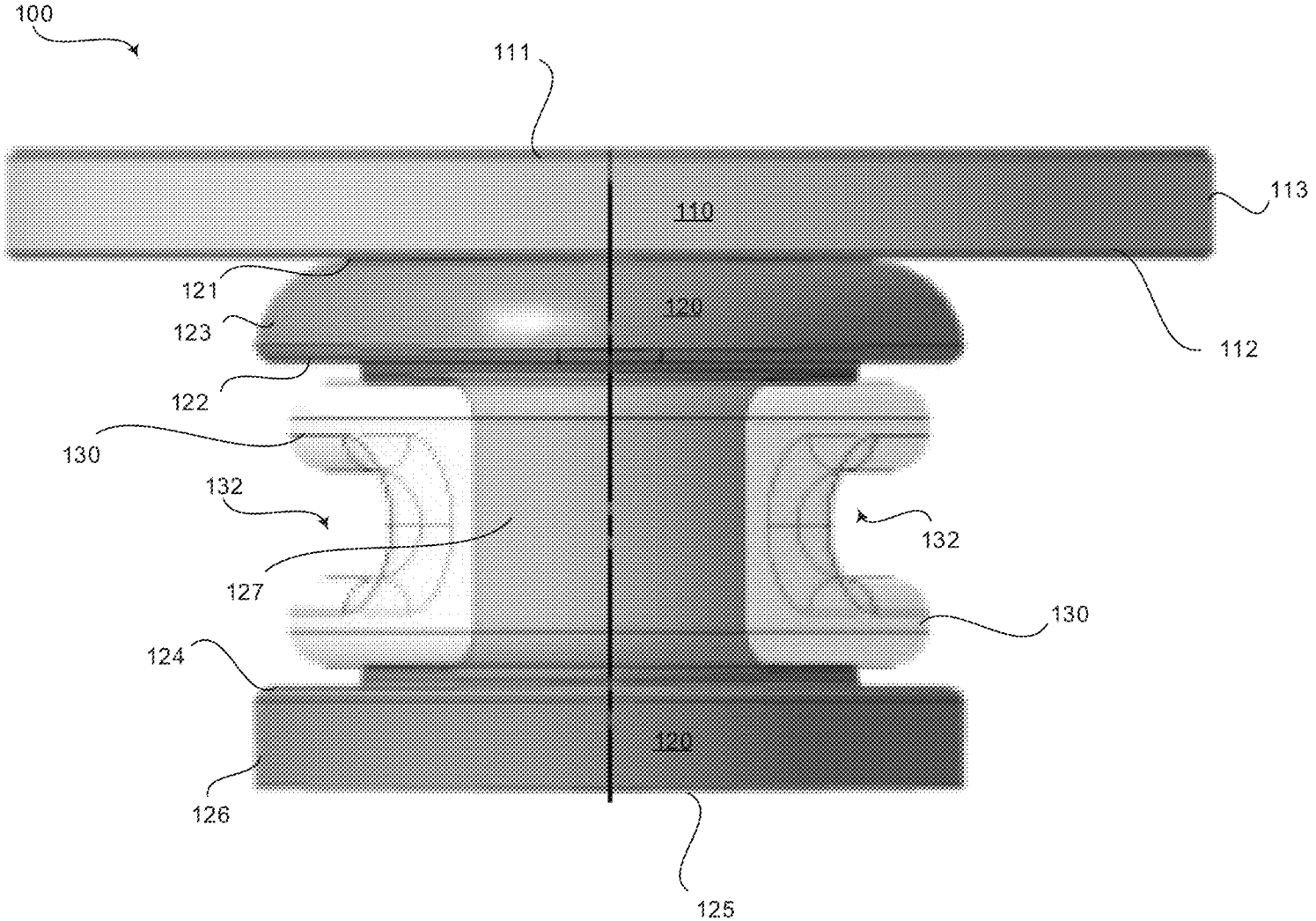
FIG. 2 is a side view of an exemplary signage apparatus, in accordance with various embodiments.
Figure 3:
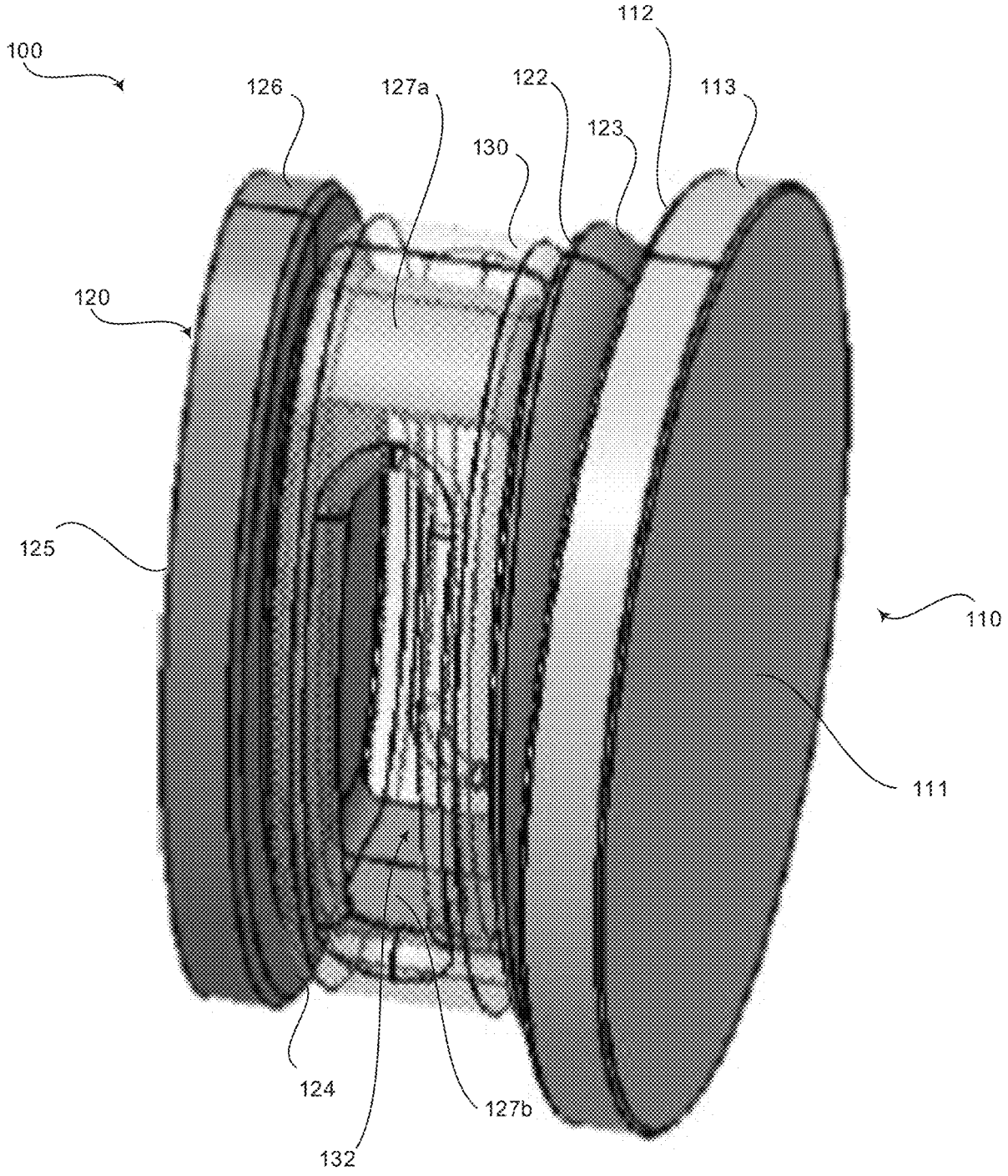
FIG. 3 is a top, front perspective view of an exemplary signage apparatus, in accordance with various embodiments.
Figure 4:
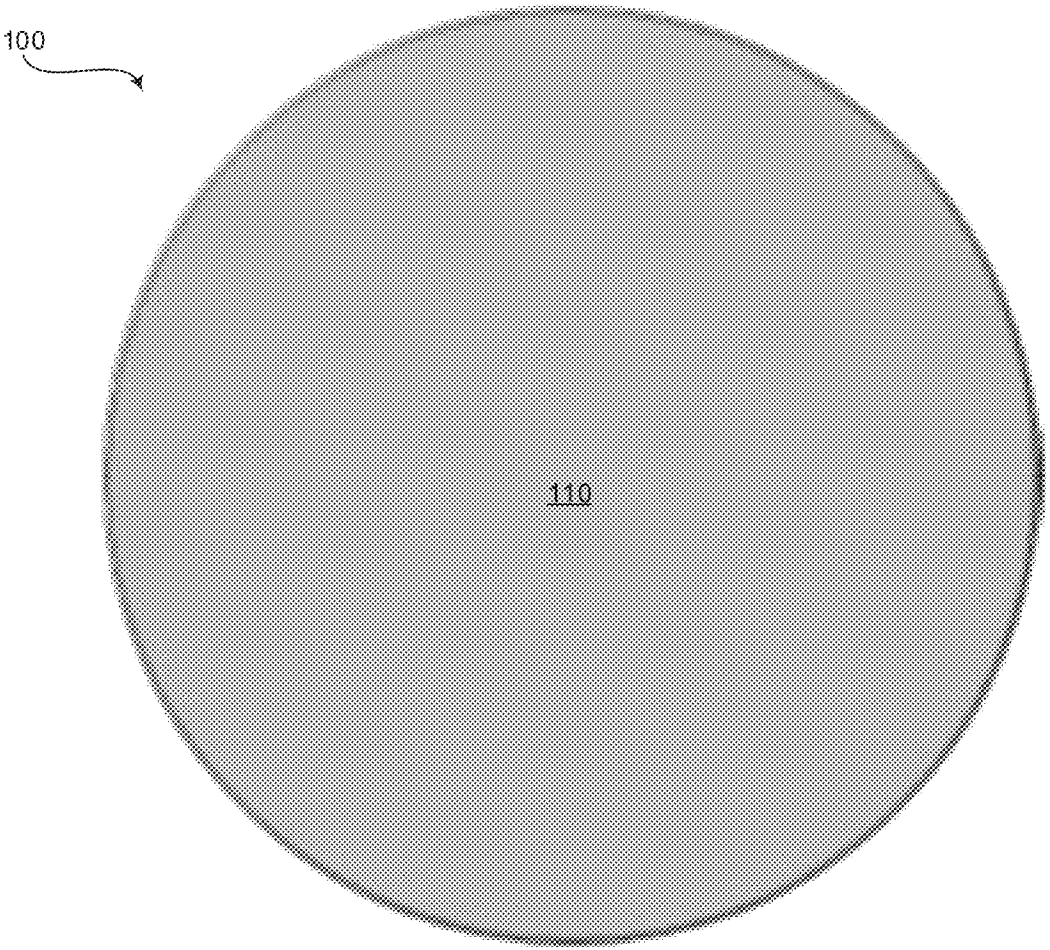
FIG. 4 is a top view of an exemplary signage apparatus, in accordance with various embodiments.

FIG. 1 is a front perspective view of an exemplary signage apparatus 100, in accordance with various embodiments. FIG. 2 is a side view of an exemplary signage apparatus 100, in accordance with various embodiments. FIG. 3 is a top, front perspective view of an exemplary signage apparatus 100, in accordance with various embodiments. FIG. 4 is a top view of an exemplary signage apparatus 100, in accordance with various embodiments.

Referring to FIGS. 1-4, the signage apparatus 100 comprises signage 110 and an attachment mechanism 120, 130. The signage 110 may comprise a front face 111, a rear face 112, and a lateral side 113. The signage may be a charm or any suitable signage. The signage 110 may be various shapes, sizes, colors, and designs, such as a football, softball, baseball, soccer ball, heart, shamrock, flower, Christmas tree, pumpkin, American flag, apple, or any suitable shape, size, color, or design. The signage 110 may include various messages, including text, numbers, symbols, or the like on the front face 111. The signage 110 may be plastic, thermoplastic, rubber, metal, and/or any suitable material. For example, the signage 100 may be polyvinyl chloride (PVC). The front face 111 of the signage may be configured to be displayed, viewable, and/or otherwise exposed. The rear face 112 of the signage 110 may be fixedly attached to the attachment mechanism 120, 130. For example, the rear face 112 of the signage 110 may be integrated with the attachment mechanism 120, 130 and/or otherwise securely coupled to the attachment mechanism 120, 130, such as by an adhesive or the like.

The attachment mechanism 120, 130 may comprise a support 120 and a flexible component 130. The support 120 may comprise a base 121-123, a cap 124-126, and outer stabilizers 127, 127*a-b*. In various embodiments, the base 121-123, cap 124-126, and outer stabilizers 127, 127*a-b* are formed as a single integrated component. The base 121-123 may comprise a base upper side 121, a base lower side 123, and a base lateral side 122 extending between the base upper side 121 and the base lower side 123. The base upper side 121 may be fixedly attached (i.e., securely connected or integrated with) to the rear face 112 of the signage 110. The cap 124-126 may comprise a cap lower side 125, a cap upper side 124, and a cap lateral side 126 extending between the cap upper side 124 and the cap lower side 125. The outer stabilizers 127, 127*a-b* may be a plurality of outer stabilizers 127, 127*a-b*, such as two (2) outer stabilizers 127*a*, 127*b*. Although two (2) outer stabilizers 127*a*, 127*b* are shown and described, additional outer stabilizers are also envisioned (e.g., four (4), six (6), or eight (8) outer stabilizers). At least one of the outer stabilizers 127, 127*a* may extend between and connect a first outer cap portion of the cap upper side 124 and a first outer base portion of the base lower side 122. At least one other of the outer stabilizers, 127*b* may extend between and connect a second outer cap portion of the cap upper side 124 and a second outer base portion of the base lower side 122. The first and second outer cap portions may be on opposite outer sides of the cap 124-126. The first and second outer base portions may be on opposite outer sides of the base 121-123. The first outer cap portion may align with and/or otherwise correspond with the first outer base portion. The second outer cap portion may align with and/or otherwise correspond with the second outer base portion. The outer stabilizers 127, 127*a-b*, and portions of the cap upper side 124 and base lower side 122 between the outer stabilizers 127, 127*a-b*, form an aperture extending through the support 120. The aperture may be substantially rectangular, square-shaped, oval, circular, or the like. The support 120 may be plastic, thermoplastic, rubber, metal, and/or any suitable material. For example, the support may be nylon plastic.

In various embodiments, the support 120 may be approximately 16.5 millimeters (i.e., 14-19 millimeters) long, approximately 10 millimeters (i.e., 7.5-12.5 millimeters) wide, and approximately 7.5 millimeters (i.e., 6-9 millimeters) tall. In an exemplary embodiment, each of the base 121-123 and cap 124-126 may be approximately 16.5 millimeters (i.e., 14-19 millimeters) long, approximately 10 millimeters (i.e., 7.5-12.5 millimeters) wide, and have a thickness of approximately 1.5 millimeters (i.e., 1-2 millimeters). The outer stabilizers 127, 127*a-b* may have a height of approximately 3.9 millimeters (i.e., 3.4-4.4 millimeters) and a thickness of approximately 1.25 millimeters (i.e., 1.0-1.5 millimeters). The aperture formed between the base lower side 122 and the cap upper side 124 may have a height of approximately 3.9 millimeters (i.e., 3.4-4.4 millimeters) and a width between the outer stabilizers 127, 127*a-b* of approximately 11 millimeters (i.e., 10-12 millimeters).

The flexible component 130 may be positioned around and between the outer stabilizers 127, 127*a-b*. The flexible component 130 comprises slits 132 on opposite sides of and/or extending through the flexible component 130. The slits 132 are positioned to align with the aperture between the outer stabilizers 127, 127*a-b*. In an exemplary embodiment, the flexible component 130 may be an O-ring made of silicone or any suitable material. The flexible O-ring 130 may be positioned around the first and second outer stabilizers 127, 127*a-b* and between the cap upper side 124 and the base lower side 122. For example, the flexible O-ring 130 may be stretched around the first outer stabilizer 127, 127*a* and the second outer stabilizer 127*b* such that an inner surface of the flexible O-ring 130 contacts the first and second outer stabilizers 127, 127*a-b*. The stretched flexible O-ring 130 provides an inward force on the first and second outer stabilizers 127, 127*a-b*. The flexible O-ring 130 having the slits 132 may be positioned such that the slits 132 align with the aperture formed in the support 120.

In an alternative embodiment, the flexible component 130 may be silicone or any suitable material that fills the space between the first and second outer stabilizers 127, 127*a* above the cap upper side 124 and below the base lower side 122. For example, the flexible component 130 may be manufactured by an injection molding, multi-shot injection molding, extrusion, and/or three-dimensional (3D) printing process (defined as a manufacturing process) with the support 120. The flexible component 130 includes the slit 132 extending through the flexible component 130 and the aperture of the support 120 from a front side of the attachment mechanism 120, 130 to a rear side of the attachment mechanism 120, 130.

In various embodiments, the signage apparatus 100 may be manufactured by a manufacturing process (i.e., injection molding, multi-shot injection molding, extrusion, and/or 3D printing) to provide a single integrated component. In certain embodiments, the signage 110 and the support 120 may be manufactured by a manufacturing process to form a single integrated component and the flexible component 130 may be a flexible O-ring comprising slits 132, where the flexible O-ring 130 is positioned around the outer stabilizers 127, 127*a-b* such that the slits 132 are aligned with the aperture of the support. In various embodiments, the attachment mechanism 120, 130 may be manufactured by a manufacturing process to form a single integrated component and the rear face 112 of the signage 110 may be fixedly secured to base upper side 121.

In operation, a piece of apparel, such as a temple of eyeglasses, a shoelace, a bracelet, or any suitable apparel, is aligned and inserted through the slit(s) 132 of the flexible component 130 and the aperture of the support 120. The flexible component 130 fits snugly around the piece of apparel, allowing a user to manipulate the signage apparatus 100 on the apparel to a desired position while firmly securing the signage apparatus 100 at the position. In other words, the signage apparatus 100 is configured to be held securely on the apparel unless or until an external force is applied to the signage apparatus, such as to position the signage apparatus 100, remove the signage apparatus 100 from the apparel, or the like.

For example, referring to FIG. 3, a right temple of eyeglasses may be inserted from the rear of the signage apparatus 100 through the slit 132 of the flexible component 130 and aperture of the support 120. As another example, a left temple of eyeglasses may be inserted from the front of the signage apparatus 100 through the slit 132 of the flexible component 130 and aperture of the support 120. In either example, the signage apparatus 100 may be slideably positioned at a desired location on the temple of the eyeglasses. The flexible component 130 snuggly surrounds the temple to hold the signage apparatus 100 at the desired location on the temple. The front face 111 of the signage 110 is on display and may be visualized by others interacting with a user wearing the eyeglasses.

Aspects of the present disclosure provide a signage apparatus 100 configured to detachably couple to apparel. The signage apparatus 100 may comprise signage 110 and an attachment mechanism 120, 130. The signage may comprise a front face 111 and a rear face 112. The attachment mechanism 120, 130 may comprise a base 121-123, a cap 124-126, a plurality of outer stabilizers 127, 127*a-b*, and a flexible component 130. The base 121-123 may comprise a base upper side 121 and a base lower side 122. The base upper side 121 may be attached to the rear face 112 of the signage 110. The cap 124-126 may comprise a cap lower side 125 and a cap upper side 124. The plurality of outer stabilizers 127, 127*a-b* may extend between outer cap portions of the cap upper side 124 and outer base portions of the base lower side 122. The plurality of outer stabilizers 127, 127*a-b*, the cap upper side 124, and the base lower side 122 form an aperture extending through the attachment mechanism 120, 130. The flexible component 130 may extend between the plurality of outer stabilizers 127, 127*a-b* and between the cap upper side 124 and the base lower side 122. The flexible component 130 may comprise at least one slit 132. The attachment mechanism 120, 130 may be configured to receive a piece of apparel through the at least one slit 132 of the flexible component 130 and the aperture.

In a representative embodiment, the outer cap portions comprise a first outer cap portion and a second outer cap portion opposite the first outer cap portion. In an exemplary embodiment, the outer base portions comprise a first outer base portion and a second outer base portion opposite the first outer base portion. In various embodiments, the first outer cap portion and the first outer base portion are aligned, and the second outer cap portion and the second outer base portion are aligned. In certain embodiments, the plurality of outer stabilizers 127, 127*a-b* comprises a first outer stabilizer 127, 127*a* and a second outer stabilizer 127*b*. The first outer stabilizer 127, 127*a* may extend between the first outer cap portion of the cap upper side 124 and the first outer base portion of the base lower side 122. The second outer stabilizer 127*b* may extend between the second outer cap portion of the cap upper side 124 and the second outer base portion of the base lower side 122.

In an exemplary embodiment, the flexible component 130 may be a flexible O-ring 130 and the at least one slit 132 is two slits 132 positioned on opposite sides of the flexible O-ring 130. In a representative embodiment, the flexible O-ring 130 may be positioned around and between the plurality of outer stabilizers 127, 127*a-b* such that the two slits 132 are aligned with the aperture. In certain embodiment, the flexible O-ring 130 may comprise silicone. In various embodiments, the flexible O-ring 130 may be stretched around the plurality of outer stabilizers 127, 127*a-b* such that an inner surface of the flexible O-ring 130 contacts the plurality of outer stabilizers 127, 127*a-b*. In a representative embodiment, the flexible O-ring 130 may provide an inward force on the plurality of outer stabilizers 127, 127*a-b*. In an exemplary embodiment, the flexible component 130 may be a manufactured material 130 (i.e., injection molded, multi-shot injection molded, extruded, and/or 3D printed material) that fills the aperture. The at least one slit 132 may be one slit 132 extending through the manufactured material 130 and the aperture. In certain embodiments, the manufactured material 130 may comprise silicone.

In various embodiments, the base 121-123, the cap 124-126, and the plurality of stabilizers 127, 127*a-b* form a support 120 of the attachment mechanism 120, 130. In certain embodiments, the support 120 may be a single integrated component. In a representative embodiment, the support 120 may comprise nylon plastic. In an exemplary embodiment, the signage 110 and the support 120 may be a single integrated component. In various embodiments, the signage 110 and the attachment mechanism 120, 130 are a single integrated component. In certain embodiments, the signage 110 may comprise polyvinyl chloride (PVC). In a representative embodiment, the signage 110 may be a charm. In an exemplary embodiment, the piece of apparel may be a temple of eyeglasses.

As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the term "exemplary" means serving as a non-limiting example, instance, or illustration. As used herein, the terms "exemplary" and "example" mean serving as a non-limiting example, instance, or illustration. As used herein, the term "e.g." and "for example" set off lists of one or more non-limiting examples, instances, or illustrations. As utilized herein, a component is "operable" and/or "configured" to perform a function whenever the component is designed and comprises the necessary element(s) to perform the function, regardless of whether the function is performed and/or whether performance of the function is disabled, or not enabled, by some user-configurable setting.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment or embodiments disclosed, but that the present disclosure will include all embodiments falling within the scope of the appended claims.

What is claimed is:

1. A signage apparatus comprising:

signage comprising a front face and a rear face; and an attachment mechanism comprising:

a base comprising a base upper side and a base lower side, the base upper side attached to the rear face of the signage;

a cap comprising a cap lower side and a cap upper side;

a plurality of outer stabilizers extending between outer cap portions of the cap upper side and outer base portions of the base lower side, wherein the plurality of outer stabilizers, the cap upper side, and the base lower side form an aperture extending through the attachment mechanism; and a flexible component extending between the plurality of outer stabilizers and between the cap upper side and the base lower side, the flexible component comprising at least one slit, wherein the attachment mechanism is configured to receive a piece of apparel through the at least one slit of the flexible component and the aperture.

2. The signage apparatus of claim 1, wherein the outer cap portions comprise a first outer cap portion and a second outer cap portion opposite the first outer cap portion.

3. The signage apparatus of claim 2, wherein the outer base portions comprise a first outer base portion and a second outer base portion opposite the first outer base portion.

4. The signage apparatus of claim 3, wherein:

the first outer cap portion and the first outer base portion are aligned, and the second outer cap portion and the second outer base portion are aligned.

5. The signage apparatus of claim 4, wherein the plurality of outer stabilizers comprises:

a first outer stabilizer extending between the first outer cap portion of the cap upper side and the first outer base portion of the base lower side; and a second outer stabilizer extending between the second outer cap portion of the cap upper side and the second outer base portion of the base lower side.

6. The signage apparatus of claim 1, wherein the flexible component is a flexible O-ring and the at least one slit is two slits positioned on opposite sides of the flexible O-ring.

7. The signage apparatus of claim 6, wherein the flexible O-ring is positioned around and between the plurality of outer stabilizers such that the two slits are aligned with the aperture.

8. The signage apparatus of claim 6, wherein the flexible O-ring comprises silicone.

9. The signage apparatus of claim 6, wherein the flexible O-ring is stretched around the plurality of outer stabilizers such that an inner surface of the flexible O-ring contacts the plurality of outer stabilizers.

10. The signage apparatus of claim 9, wherein the flexible O-ring provides an inward force on the plurality of outer stabilizers.

11. The signage apparatus of claim 1, wherein the flexible component is a manufactured material that fills the aperture, wherein the at least one slit is one slit extending through the manufactured material and the aperture.

12. The signage apparatus of claim 11, wherein the manufactured material comprises silicone.

13. The signage apparatus of claim 1, wherein the base, the cap, and the plurality of stabilizers form a support of the attachment mechanism.

14. The signage apparatus of claim 13, wherein the support is a single integrated component.

15. The signage apparatus of claim 13, wherein the support comprises nylon plastic.

16. The signage apparatus of claim 13, wherein the signage and the support are a single integrated component.

17. The signage apparatus of claim 1, wherein the signage and the attachment mechanism are a single integrated component.

18. The signage apparatus of claim 1, wherein the signage comprises polyvinyl chloride (PVC).

19. The signage apparatus of claim 1, wherein the signage is a charm.

20. The signage apparatus of claim 1, wherein the piece of apparel is a temple of eyeglasses.

* * * * *